US006289808B1

(12) United States Patent
Tse

(10) Patent No.: US 6,289,808 B1
(45) Date of Patent: Sep. 18, 2001

(54) INK REFILL FOR PRINTING DEVICE

(76) Inventor: Mee Shuen Wilson Tse, 4/F., Remex Centre, 42 Wong Chuk Hang Road, Won Chuk Hang (HK)

( * ) Notice: Subject to any disclaimer, the term of this patent is extended or adjusted under 35 U.S.C. 154(b) by 0 days.

(21) Appl. No.: 09/369,891

(22) Filed: Aug. 9, 1999

(51) Int. Cl.[7] ..... B41F 31/02

(52) U.S. Cl. ..... 101/364; 101/335; 101/327; 401/135; 401/132; 347/85

(58) Field of Search ..... 101/327, 333, 101/364, 366, 405, 335; 347/85, 86, 87; 401/132, 133, 134, 135

(56) References Cited

U.S. PATENT DOCUMENTS

| | | | | |
|---|---|---|---|---|
| 4,022,127 | | 5/1977 | Carlsson et al. | 101/327 |
| 4,217,058 | * | 8/1980 | Staszewski et al. | 401/135 |
| 4,995,751 | * | 2/1991 | Saint Georges Chaume | 401/135 |
| 5,435,660 | * | 7/1995 | Wirt | 401/135 |
| 5,510,820 | * | 4/1996 | Aulick et al. | 347/85 |
| 5,967,196 | * | 10/1999 | Moser | 347/85 |
| 6,053,604 | * | 4/2000 | Sato et al. | 347/85 |

FOREIGN PATENT DOCUMENTS

| | | |
|---|---|---|
| P3512818.6 | 4/1985 | (AU) . |
| 2384627 | 3/1977 | (FR) . |
| 2689453 | 10/1993 | (FR) . |
| 2226276A | 6/1990 | (GB) . |
| 2226985A | 7/1990 | (GB) . |
| 2236981A | 4/1991 | (GB) . |

* cited by examiner

*Primary Examiner*—John S. Hilten
*Assistant Examiner*—Leslie J. Grohusky
(74) *Attorney, Agent, or Firm*—Burns Doane Swecker & Mathis LLP

(57) ABSTRACT

A container having a first end and a second end, an internal cavity located within the container which provides an opening in the first end and extends towards the second end; a portion of the container, having an attached end and a free end, may be detached from a remaining portion so as to expose the internal cavity; and the free end is configured so that it may be seal the internal cavity once the portion of the container is detached.

13 Claims, 4 Drawing Sheets

INK REFILL FOR PRINTING DEVICE

This invention relates to ink stamps, ink refills, and ink stamp and ink refill combinations. In particular, the invention relates to ink stamps of the type in which an ink impression is made on a substrate, e.g. a piece of paper, by placing the stamp over the region of the paper to be printed and then resiliently depressing a handle to push an inked surface down onto the paper. An ink stamp of this type is shown in U.S. Pat. No. 4,022,127.

BACKGROUND OF THE INVENTION

Improvements to this type of ink stamp are disclosed in UK Patent Nos. GB 2226276, GB 2226985 and GB 2236981. Contents of the above patent documents are incorporated herein for reference purpose.

When such a prior art ink stamp runs out of ink, fresh ink is introduced directly onto the lower relief printing surface of the stamp. As it takes several hours before the newly-introduced ink is fully and evenly absorbed by the pre-inked stamp, when the stamp is applied on a substrate, e.g. a piece of paper, shortly after the stamp is replenished with ink, more ink than is desirable will be applied on the piece of paper. It is also found in practice that the existing method of replenishing ink to the stamp is cumbersome.

It is thus an object of the present invention to provide an ink stamp, an ink refill, and an ink stamp and ink refill combination, in which the aforesaid shortcomings are mitigated, or at least to provide a useful alternative to the public.

SUMMARY OF THE INVENTION

According to a first aspect of the present invention, there is provided an ink stamp including a body member, wherein said body member includes a base member with edges for resting on a surface to which an inked impression is to be applied, and stamping means to which a stamp member is securable, wherein said stamping means is movable relative to said base member for selectively moving said stamp member into or out of contact with said surface, and wherein channel means extends from an exterior of said stamping means into at least part of said stamping means to thereby allow ink to be supplied to said stamp member.

According to a second aspect of the present invention, there is provided an ink refill including means for containing an ink, said containing means including at least first and second ends, wherein said first end is closable by covering means, and wherein said second end is removable from said ink refill to allow exit of said ink from said containing means.

According to a third aspect of the present invention, there is provided an ink stamp and ink refill combination, including an ink stamp and an ink refill which are releasably engageable with each other.

BRIEF DESCRIPTION OF THE DRAWINGS

An example of an embodiment of the present invention will now be described and with reference to the following drawings, in which.

DETAILED DESCRIPTION OF THE PREFERRED EMBODIMENTS

Figure 1:
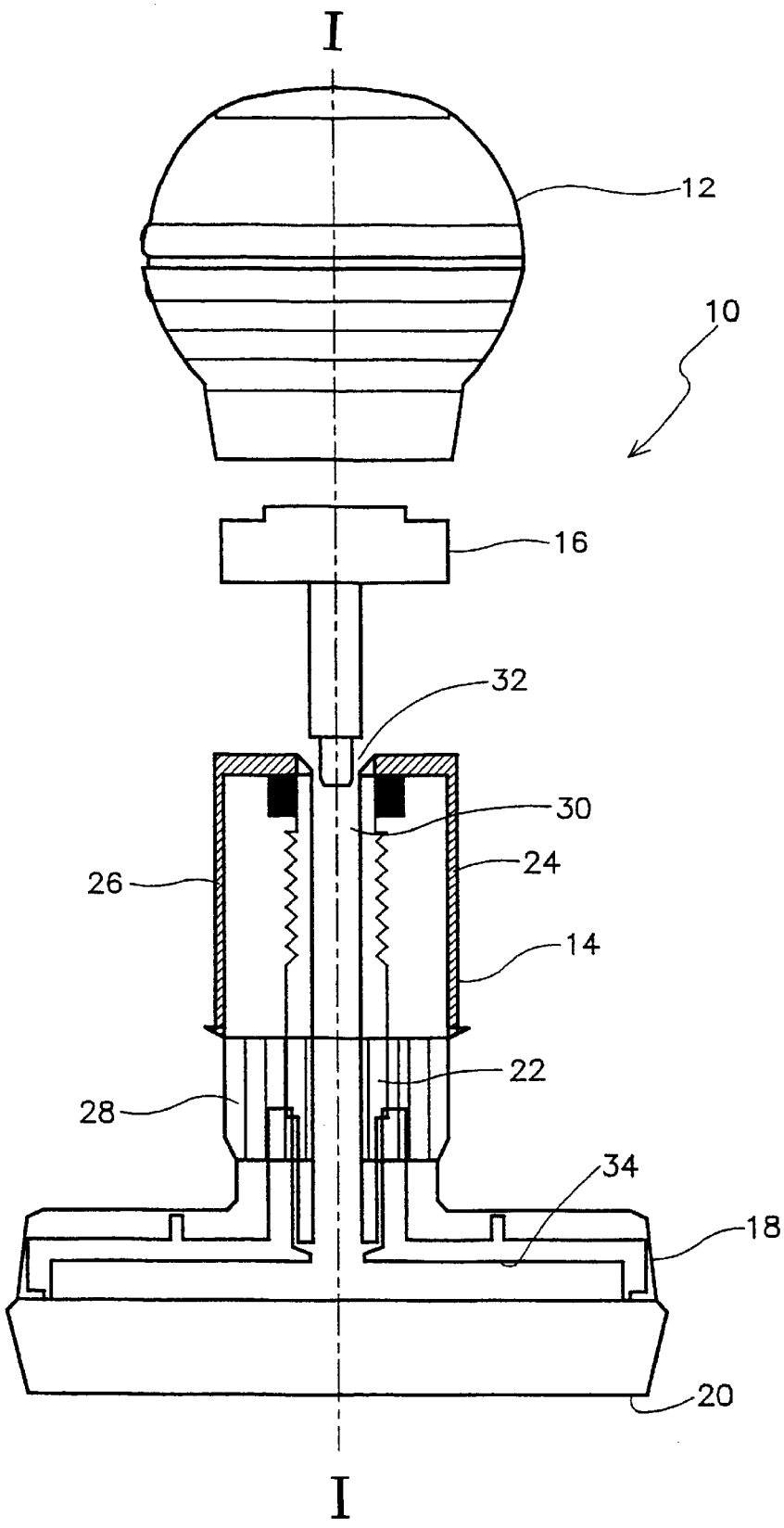
FIG. 1 is an exploded view of an ink stamp and ink refill combination according to the present invention.

As shown in FIG. 1, an ink stamp according to the present invention is generally designated as 10. The ink stamp 10 includes a top handle 12 in a generally globe shape, and a body 14 which may be detachably secured with the handle 12. The handle 12 has an opening (not shown) on its underside which leads to a cavity within the handle 12, so that when the handle 12 is secured with the body 14, an ink refill 16 may be contained within the cavity formed by the handle 12 and the body 14.

The general structure of the body 14 is similar to the prior art ink stamps, and in particular that disclosed in GB 2 226 276. The body 14 includes a base 18 with downwardly extending edges 20 for bearing on a surface of a substrate, e.g. a piece of paper, to be stamped. Extending upwardly from the base 18 is a central shaft 22. The body 14 also includes a stamping mechanism 24. In particular, the stamping mechanism 24 includes a hollow cylinder 26 and an adjustment screw 28 which are secured to each other for movement. The shaft 22 extends into a central cavity of the stamping mechanism 24 so that the stamping mechanism 24 is slidably movable relative to the base along the central axis I—I shown in FIG. 1. Provided between the stamping mechanism 24 and the base 18 is a spring (not shown) which biases the stamping mechanism 24 upward and thus away from the base 18. It is, however, possible to depress the handle 12 to move the stamping mechanism 24 downwardly relative to the base 18 and against the biasing force of the spring, in order to bring a pre-inked stamp (not shown) into contact with the substrate to be stamped. After stamping, the downward pressing force may be removed to allow the stamping mechanism 24 to move up relative to the base 18 under the action of the biasing force of the spring between the stamping mechanism 24 and the base 18.

The adjustment screw 28 limits the extent of downward movement of the stamping mechanism 24 relative to the base 18. It is also possible to rotate the adjustment screw 28 about the axis I—I to adjust the extent of downward movement of the stamping mechanism 24 relative to the base 18. The above structure and functions are clearly discussed in the prior art documents referred to above.

A novel feature of the present invention is that the body 14 includes a central channel 30 which opens to the exterior of the body 14 via an upper opening 32. This channel 30 extends along the central axis I—I to a lower surface 34 of the stamping mechanism 24. A stamp (not shown) includes two major surfaces each of essentially the same size and shape as the lower surface 34. One of the major surfaces of the stamp is engraved with at least one pattern and is adapted to come into contact with the substrate to be stamped. Another major surface of the stamp may abut and be fixedly secured to the lower surface 34 by an adhesive, e.g. glue.

It can thus be seen that, with this arrangement, ink may be introduced to the upper major surface of the stamp via the upper opening 32 and through the channel 30. As it will take some time for the ink so introduced to be fully absorbed by the stamp, and to migrate to the lower engraved surface of the stamp, the stamp will not provide a more-than-desirable amount of ink when it is applied onto the substrate after it is freshly replenished with ink.

Figure 2A:
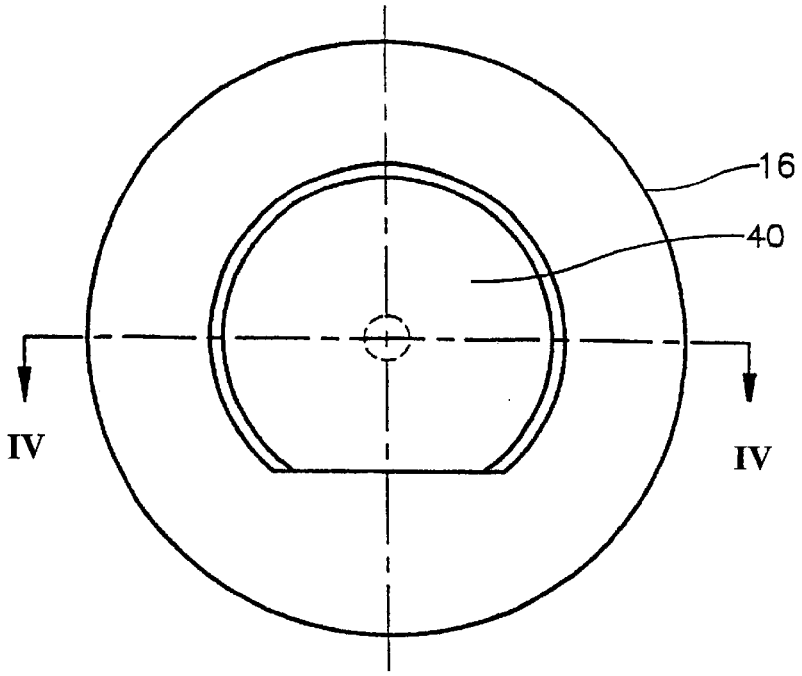
FIG. 2A is a top view of the ink refill shown in FIG. 1.
Figure 2B:
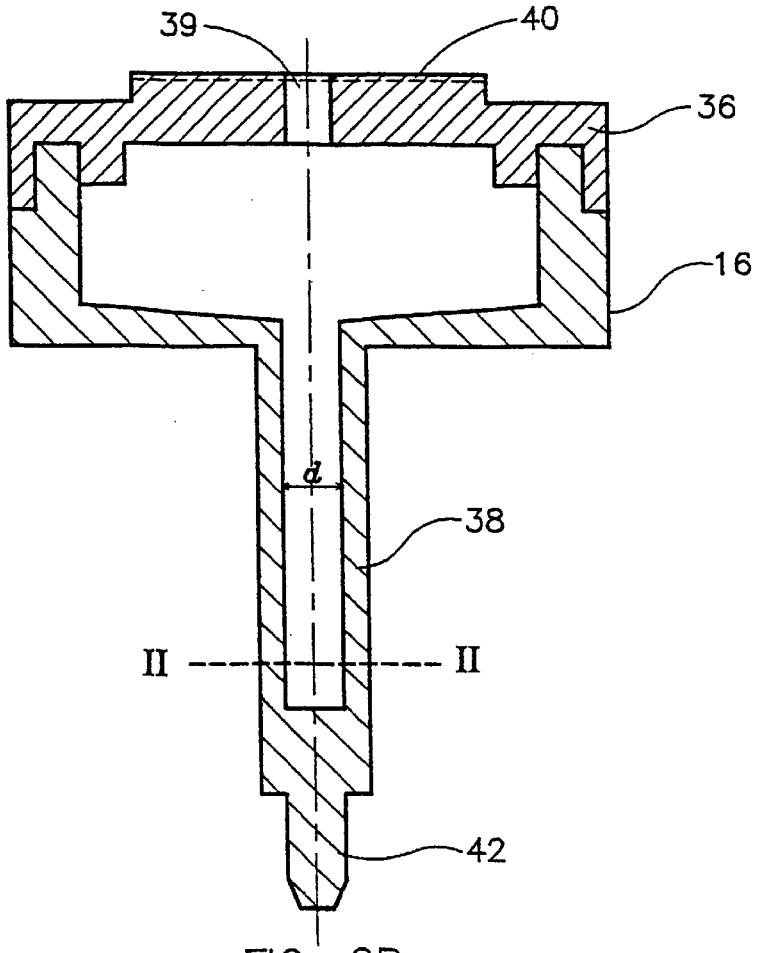
FIG. 2B is a sectional view of the ink refill taken along the line IV—IV in FIG. 2A.

Turning now to FIGS. 2A and 2B, such show in more details the ink refill 16 shown in FIG. 1. As can be seen, the ink refill 16 includes an upper wider cylindrical part 36 and a lower narrower cylindrical part in the form of a tube 38. These two cylindrical parts 36, 38 are in communication with each other and within which an ink may be contained. In particular, the internal volume of the cylindrical part 36 is larger than that of the tube 38. The upper end of the ink refill 16 includes an air hole 39 which is covered by a reusable adhesive paper/label 40, and the lower end of the ink refill 16 includes a pin 42.

It should be understood that the outer diameter of the pin 42 is equal to or slightly smaller than the inner diameter d of the tube 38, and that the outer diameter of the tube 38 is equal to or slightly smaller than the inner diameter of the channel 30. As can be seen in FIG. 1, by way of such an arrangement, the tube 38 may be received within the channel 30, and the upper cylindrical part 36 may sit on the hollow cylinder 26, thus releasably engaging the ink refill 16 to the body 14.

Figure 2C:
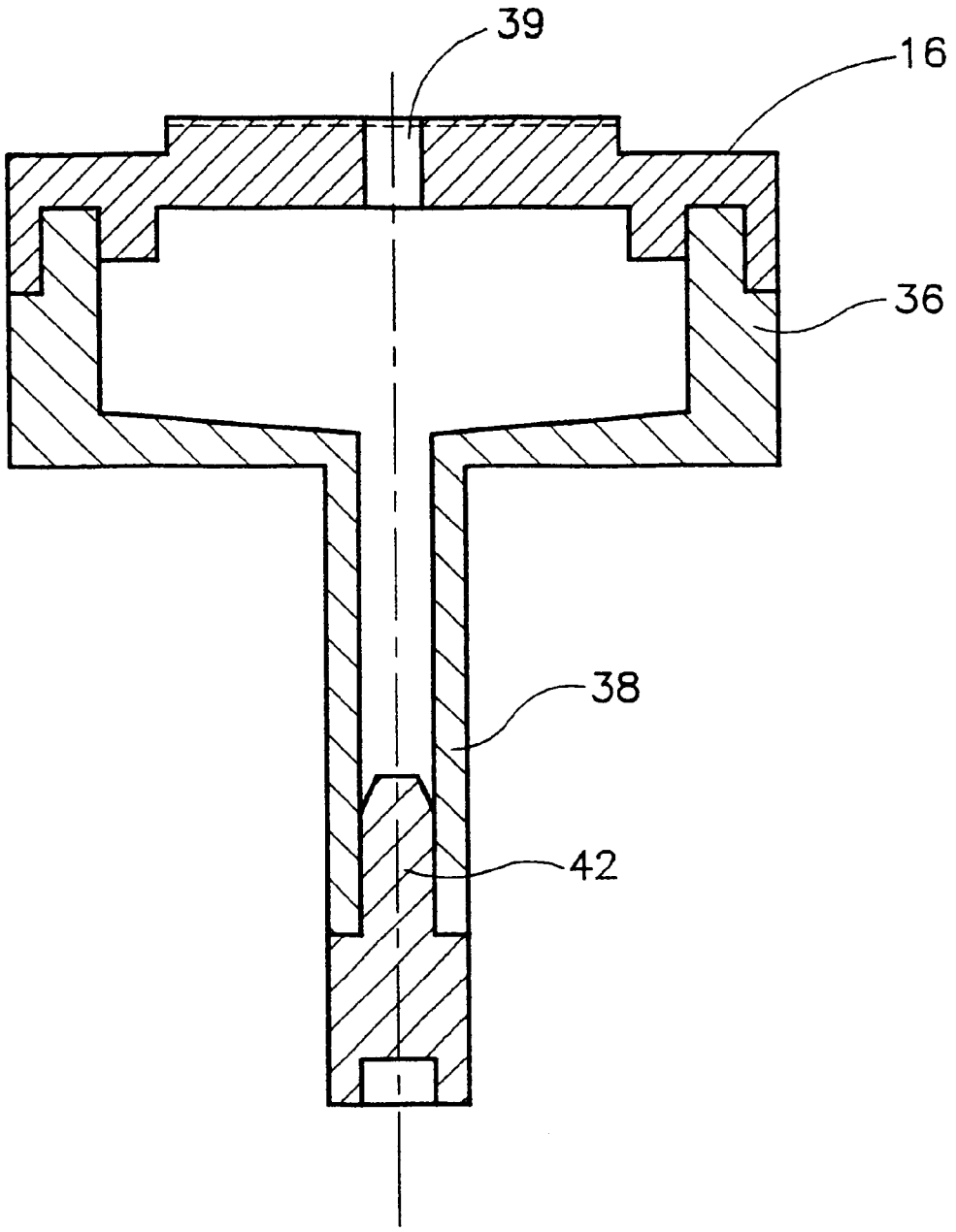
FIG. 2C is a sectional view of the ink refill after an end of the refill is broken off along the line II—II in FIG. 2B, and re-fitted with the ink refill.

When ink is to be introduced into the channel 30, the lower end of the ink refill 16 may be broken off, e.g. along the line II—II shown in FIG. 2B. However, due to the atmospheric pressure, the ink contained in the cylindrical parts 36, 38 will not flow out of the refill 16 until the adhesive paper/label 40 is peeled off or removed to expose an the air hole 39 to the outside environment. When a sufficient amount of ink has been introduced into the channel 30, the air hole 39 may again be covered by the reusable adhesive paper/label 40 to stop further outflow of the ink. In order to ensure better concealment of the ink refill 16, the tip 42 of the broken-off end part may be inserted into the inner cavity of the tube 38, in the manner as shown in FIG. 2C. In any event, the ink refill 16 may stay engaged with the body 14, i.e. within the cavity formed by the handle 12 and the body 14.

Figure 3A:
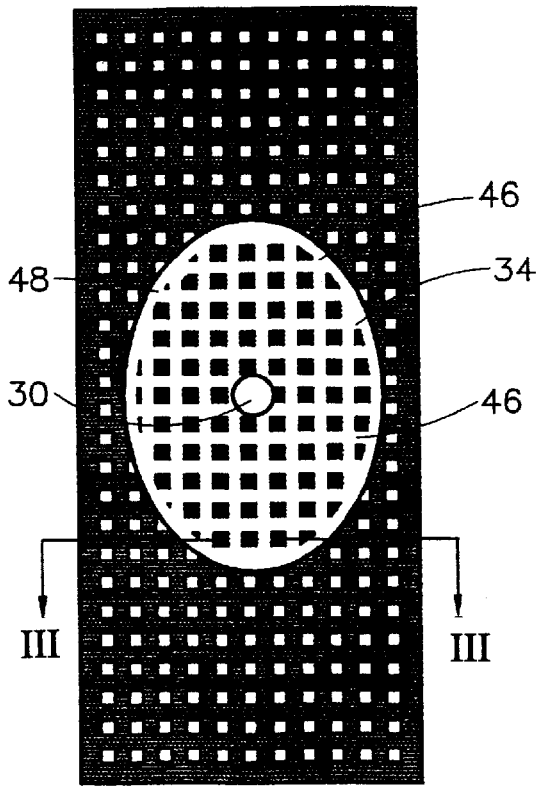
FIG. 3A is a bottom view of the stamp shown in FIG. 1.
Figure 3B:
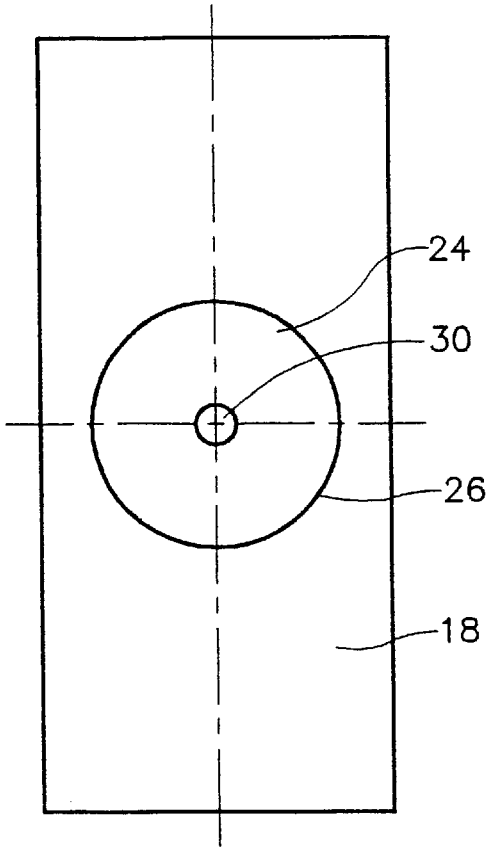
FIG. 3B is a top view of the stamp shown in FIG. 1, with the top handle removed.
Figure 3C:
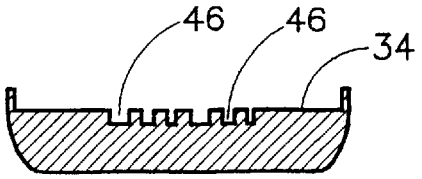
FIG. 3C is a sectional view of the stamp taken along the line III—III in FIG. 3A.

As shown in FIGS. 3A and 3B, the lower surface 34 of the stamping mechanism 24 includes a number of recesses 46 (shown in FIG. 3A as white areas) within an oval part 48, and the channel 30 is in a water communicable relationship with these recesses 46. FIG. 3C shows a sectional view of the stamping mechanism 24 along the line III—III in FIG. 3A, i.e. with the stamping mechanism 24 in an upside down position. It can be seen that, with the provision of the recesses 46, and with the stamp fixedly secured to the lower surface 34, spaces are provided between the recesses 46 and the stamp so that the freshly introduced ink may be stored within these spaces until such is fully absorbed by the stamp. Such allows the ink to be evenly distributed within and absorbed by the stamp.

What is claimed is:

1. An ink refill, comprising:

a container with an internal cavity, said container including a first body portion and a second body portion joined with each other, wherein said first body portion includes an opening;

a closing member removably closing said opening of said first body portion;

wherein said second body portion includes a first end joined with said first body portion, and a distal second end;

wherein said second body portion is removable from said container to expose said internal cavity; and wherein at least part of said distal end of said second body portion is adapted to be received within at least part of said internal cavity of said container to close said internal cavity.

2. The ink refill according to claim 1, wherein said ink refill is adapted to allow contents in said container to exit when said closing member is removed and said second body portion is detached from said container.

3. The ink refill according to claim 1, wherein said closing member includes an adhesive member.

4. The ink refill according to claim 3, wherein said adhesive member is an adhesive paper or adhesive label.

5. The ink refill according to claim 1, wherein closing member is reusable.

6. The ink refill according to claim 1, wherein said first and second body portions are integral with each other.

7. The ink refill according to claim 1, wherein said first body portion includes a wide portion and a narrow portion.

8. The ink refill according to claim 7, wherein said narrow portion of said first body portion includes a channel portion with an internal diameter substantially the same as an external diameter of a free end of said distal end of said second body portion.

9. The ink refill according to claim 8, wherein at least part of said distal end of said second body portion is adapted to be received within at least part of said channel portion.

10. An ink refill, comprising:

a container having a first end and a second end;

an internal cavity located within said container which provides an opening in said first end and extends towards the second end;

wherein a portion of the container, having an attached end and a free end, may be detached from a remaining portion so as to expose said internal cavity; and wherein said free end is configured so that it seals the internal cavity by insertion into said cavity once the said portion of the container is detached.

11. The ink refill according to claim 10, further comprising a closing member removably sealing said opening.

12. The ink refill according to claim 10, wherein said portion of said container which is detached from said remaining portion is located closer to the second end of said container.

13. The ink refill according to claim 10, wherein said container comprises a first body part and a second body part and said portion of said container which is detached is located on the second body part.

* * * * *